United States Patent [19]

Jakubowicz et al.

[11] Patent Number: 4,852,620

[45] Date of Patent: Aug. 1, 1989

[54] PIPETTE WITH INVERTED BELLOWS

[75] Inventors: Raymond F. Jakubowicz, Rush; Johannes J. Porte, Webster, both of N.Y.

[73] Assignee: Eastman Kodak Company, Rochester, N.Y.

[21] Appl. No.: 183,970

[22] Filed: Apr. 20, 1988

[51] Int. Cl.[4] ..... B01L 3/02

[52] U.S. Cl. ..... 141/25; 141/24; 141/114; 141/130; 73/863.71; 73/863.84; 73/863.32; 73/864.13; 73/864.62; 422/100; 222/633

[58] Field of Search ..... 141/21–28, 141/250, 114, 130; 73/863.31, 863.71, 863.84, 863.83, 863.32, 864.11, 864.13, 864.16, 864.62; 422/100; 222/630–633

[56] References Cited

U.S. PATENT DOCUMENTS

| | | | |
|---|---|---|---|
| Re. 32,210 | 7/1986 | d'Autry | 73/864.14 |
| 2,595,493 | 5/1962 | Slaby et al. | 141/24 |
| 3,343,422 | 9/1967 | McSmith | 73/864.03 |
| 3,982,438 | 9/1976 | Byrd | 73/863.32 |
| 4,009,611 | 3/1977 | Koffer et al. | 73/864.14 |
| 4,041,955 | 8/1977 | Columbus | 141/275 |
| 4,047,438 | 9/1977 | Sekine | 73/863.32 |
| 4,054,062 | 10/1977 | Branham | 73/864.14 |
| 4,158,035 | 6/1979 | Haase et al. | 422/100 |
| 4,257,267 | 3/1981 | Parsons | 73/864.14 |
| 4,296,071 | 10/1981 | Weiss et al. | 73/864.11 |
| 4,444,062 | 4/1984 | Bennett et al. | 73/863.32 |
| 4,511,534 | 4/1985 | Bennett, Jr. et al. | 422/100 |
| 4,532,805 | 8/1985 | Flesher | 73/863.32 |
| 4,537,231 | 8/1985 | Hasskamp | 141/238 |
| 4,626,509 | 12/1986 | Lyman | 422/100 X |

FOREIGN PATENT DOCUMENTS 449894 7/1949 Italy .

*Primary Examiner*—Ernest G. Cusick
*Attorney, Agent, or Firm*—Dana M. Schmidt

[57] ABSTRACT

There is disclosed a pipette and a method of using the pipette in which an active element of the pressurizing system is a bellows within a piston chamber, operated by a motor. To achieve the advantages of the invention, including ease in manufacturing and the ability to actuate a tip ejector, the bellows is mounted so that the outside surface of the sidewall of the bellows, together with the piston chamber, defines the air volume operative on a fluid passageway leading to a disposable tip.

4 Claims, 3 Drawing Sheets

PIPETTE WITH INVERTED BELLOWS

FIELD OF THE INVENTION

The invention relates to devices for aspirating and dispensing liquid, such as pipettes.

BACKGROUND OF THE INVENTION

Pipettes and automatic aspirators are constructed preferably with disposable tips or containers, means for mounting the tips or containers, and means for pressurizing or evacuating the contents of the tips or containers. The pressurizing means then comprise a piston chamber, a piston, and means for reciprocating the piston. Most commonly, the piston uses sealing rings that rub against the inside wall of the piston chamber or outside wall of the piston.

Because such rings are subject to wear, bellows have been suggested as an alternative since they have a much longer wear capability. Such bellows can be prestressed and simply compressed manually, as shown in U.S. Pat. No. 4,296,071, or they can be driven by a motor as shown in U.S. Pat. No. 4,041,995, FIGS. 6 and 8. In either case, some manufacturing difficulties are encountered. In the case of a simple bellows that is of the type shown in the '995 patent, it is difficult to attach the base portion of the bellows to the bottom of the piston chamber, simply because of inaccessibility. A solution would be to assemble the chamber housing in several parts, but it is preferred, e.g., for convenience, to have such a housing be one integral part.

One approach to this problem has been to use a flat elastomoeric membrane in place of a bellows, for example, as shown in U.S. Pat. No. 4,444,062, since such a membrane can be secured to the top of the piston chamber. As the piston is advanced, FIG. 4 of the '062 patent, the membrane (68) is stretched into a cylindrical shape. However, such a design encounters the following disadvantages: the elastomeric membrane tends to crack under the high stress that is delivered, and is therefore short-lived. Furthermore, it provides a non-linear displacement since the cross-sectional shape changes as the piston is advanced. A bellows does not suffer these disadvantages. Thus, such a flat membrane is not a suitable substitute for a bellows. Therefore, prior to this invention there has been a need to provide a more readily manufacturable bellows design as a piston ring replacement.

Yet another problem exists with such bellows construction. Many pipettes have a disposable tip ejector comprising a rod extending from the tip mounting surface, back into the end of the piston chamber nearest to the disposable tip. Such rods need to be pushed at the appropriate moment, such as by extending the piston until it contacts the rod. However, when a bellows is disposed in between the piston and the end of the chamber at which the rod is located, excessive power is required to activate the rod. That is, not only must the piston push against the resistance of the rod and tip, but also it must collapse the bellows.

For the above reasons, bellows have had limited utility in use as replacement of piston seals, in spite of their advantage in wearing.

SUMMARY OF THE INVENTION

We have developed a pipette construction in which a folded membrane such as a bellows can be used in the means actually creating the pressure or vacuum in the disposable tip, and still overcome the problems noted above. The key to this solution is to use a bellows that is inverted from the bellows position heretofore used for pressurizing the pipette.

More specifically, in accord with one aspect of the invention there is provided a pipette comprising first means for mounting a disposable tip including a fluid passageway through the means, and second means for creating an operative vacuum or a pressure in the passageway different from atmospheric pressure, the second means including a piston chamber having an end fluidly connected to said fluid passageway, a piston and a bellows mounted for movement within the chamber, the bellows having a preformed sidewall with an inside surface and an outside surface, and actuating means for advancing or retracting the piston. The pipette is improved in that the bellows is mounted in the chamber and on the piston so that the outside surface and the piston chamber define the air volume operative on the fluid passageway, whereby the bellows is readily assembled in the chamber and the actuating means requires minimal force to fully extend the piston to the chamber end.

In accord with another aspect of the invention, there is provided a method of aspirating and dispensing liquid into and from a pipette of the type noted above. The method comprises the steps of:

(a) inserting the pipette into a source of the liquid;

(b) creating a partial vacuum within the fluid passageway by collapsing the bellows with the piston, whereby liquid is drawn into the tip;

(c) moving the pipette relative to the source of liquid and to an object onto which the liquid is to be dispensed; and (d) creating a partial pressure within the fluid passageway sufficient to expel at least a portion of the liquid, by moving the piston in a direction that allows the bellows to expand from its collapsed state created in step (b).

Thus, it is an advantageous feature of the invention thata pipette is provided with a pressurizing means that has the infinite wear characteristics of a bellows, but without the manufacturing problems heretofore required with a bellows.

It is another advantageous feature of the invention that a pipette is provided with a pressurizing means that has the infinite wear characteristics of a bellows, but without the manufacturing problems heretofore required with a bellows.

It is another advantageous feature of the invention that a pipette is provided with such a bellows in the pressurizing means, such that the resistance of the bellows does not interfere with the actuation of a tip ejecting rod.

Other advantageous features will become apparent upon reference to the following detailed Description of the Preferred Embodiments, when read in light of the attached drawings.

DESCRIPTION OF THE PREFERRED EMBODIMENTS

The invention is hereinafter preferred in connection with a preferred embodiment in which the device is a hand-held pipette, used with a single-sized disposable tip and motor actuation. The invention is useful also in a pipette that is machine-manipulated, and/or is used with more than one-sized tip, as shown for example in U.S. Pat. No. 4,593,837 by R. Jakubowicz et al. It is further useful whether the piston of the pipette is actuated by a motor, as shown herein, or by a rod pushed manually against a return spring.

It will be readily apparent that a bellows, be it mounted in a manner as provided for in this invention, or unmounted, is simply a special case of a folded membrane, comprising many folds. As used herein, "folded" refers to the presence of at least one fold in the sidewall of the membrane, to distinguish over a taut membrane that is not useful because of the high resistance forces that resist displacement of the membrane when the piston is moved.

Figure 1:
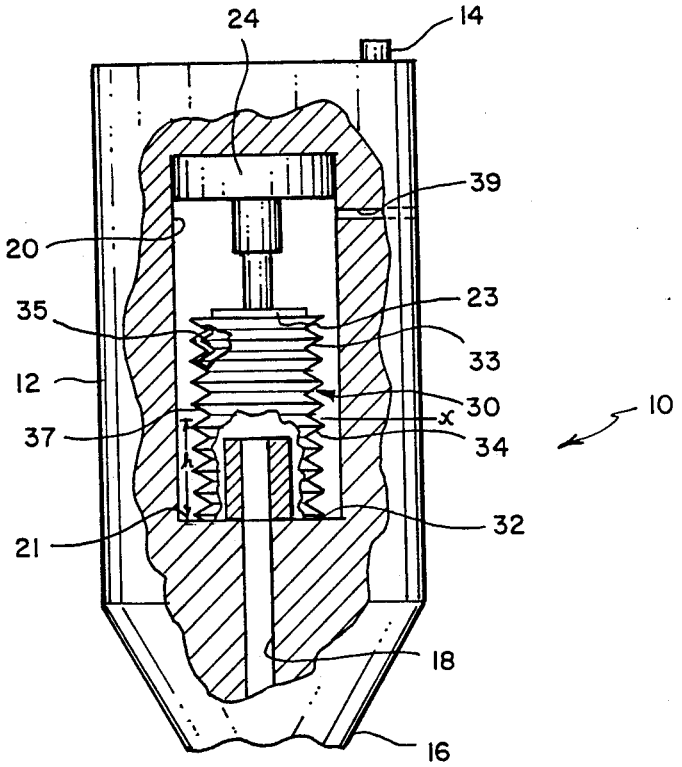
FIG. 1 PRIOR ART
FIG. 1 is a fragmentary elevational view, partly in section, of a pipette utilizing a bellows and piston in a conventional configuration.

A conventional pipette construction is illustrated in FIG. 1. The pipette 10 has a body 12 and controls 14 at one end. A pipette tip, not shown, is mounted at or adjacent to end 16. A piston 23 in piston chamber 20 generates the partial vacuum and pressure needed to aspirate fluid in, or eject fluid out of the tip. Fluid passageway 18 extends from end 21 of chamber 20 to the pipette end 16. Piston 23 is mounted for movement as driven by motor 24. To replace sealing O-rings, a bellows 30 is provided, with a base portion 32 sealed to chamber end 21. Top portion 23 of the bellows is connected to piston 23. A generally cylindrical sidewall 34 with multiple folds extends between base 32 and top portion 33. The sidewall has an inside surface 35 and an outside surface 37. Most importantly, by this construction it is the inside surface 35 of the sidewall 34 that generates the operative vacuum or pressure that causes air flow within passageway 18 and fluid flow within the pipette tip (not shown). The air volume defined by outside surface 37 and chamber 20 does not affect passageway 18. Instead it is vented via passageway 39, to the atmosphere.

It is a characteristic of such a bellows construction that it can not be readily compressed much below position X. This results in a dead air volume, within the bellows, having a height "h".

It will be readily appreciated that a key problem with such a construction is accessibility in attaching base portion 32 to surface 21. That is, if such portion 32 is to be adhered such as by epoxy adhesive, it is not readily possible to ensure such adherence, given the small volume existing between outside surface 37 of the bellows and the wall of chamber 20.

Figure 2:
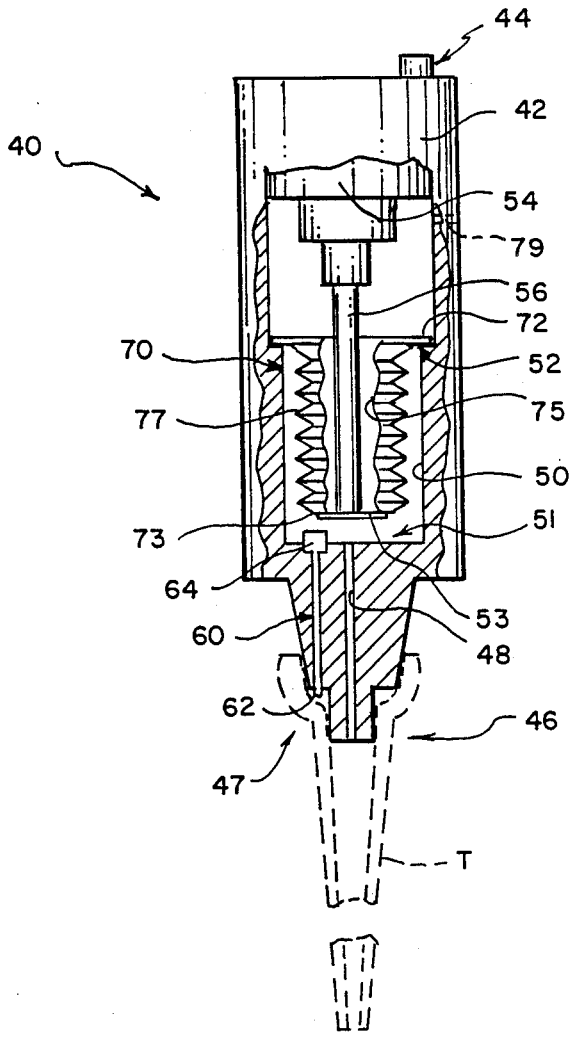
FIG. 2 is an elevational view, partly in section, of a pipette constructed in accordance with the invention.

In accordance with the invention, the pipette is improved, FIG. 2, by constructing the pipette so that the bellows is inverted and it is the outside surface of the bellows that defines the air volume that generates the operative vacuum or pressure to cause fluid to flow within the tip. Pipette 40 constructed in such a manner has features similar to those of FIG. 1, namely a body 42 in which is contained the pressurizing means as before, and control switches 44 (of conventional construction). At opposite end 46, a conical surface 47 is provided that mounts disposable pipette tips T, shown in phantom. A fluid passageway 48 comprises part of end 46, and extends thereto from a piston chamber 50 located internally of body 42. Chamber 50 has generally opposite ends 51 and 52. A piston 53 is mounted for reciprocation within chamber 50, driven by a conventional linear actuator motor 54 via a drive shaft 56. Motor 54 can be, for example, a K92211-P2 motor obtained under the trademark AIRPAX from North American Phillips Company.

To eject the disposable tip T after its use is finished, an ejection rod 60 is mounted in body 42. One end 62 of the rod is disposed adjacent surface 47 in contact with a disposable tip. Opposite end 64 is disposed adjacent end 51 of chamber 50 and projects into chamber 50. Rod 60 is slidably mounted to reciprocate parallel to passageway 48, when actuated by piston 53, as is conventional.

As noted, an active element of the pressurizing means for the pipette is bellows 70 comprising a base 72, an expandable, generally cylindrical sidewall 74, and a top portion 73. Shaft 56 thus extends through the inside of the bellows and is secured to piston 53 mounted at top portion 73 of the bellows. Base 72 is secured to chamber end 52 that is different from end 51. Thus, it is the outside surface 77, rather than the inside surface 75, that forms the active air volume, with chamber 50, to pressurize or evacuate passageway 48. Passageway 79 vents to the atmosphere.

In this construction, the dead air volume is minimized since the bellows, when fully expanded, occupies almost all of the volume of chamber 50. Furthermore, the least force is required by motor 54 to move piston 53 to that fully expanded position, or even beyond, compared to the force expended to completely compress such a bellows.

Yet another advantage is that the bellows need not be fully compressed to allow piston 53 to be extended into contact with end 64 of ejection rod 60. Instead, bellows 70 need only be stretched slightly beyond its home position (shown in FIG. 2) - a task that presents a minimal load to motor 54 and therefore provides full motor torque for the purpose of tip ejection.

Useful materials for bellows 70 include nickel alloy, for example one having a spring constant of less than 1.75 N/cm (1 lb/inch).

A vent 79 is provided for venting the interior of bellows 70 to the atmosphere.

Alternatively (not shown), bellows can be used as the pressurized means in a second chamber needed, for example, in constructing a pipette to accept two-differently sized tips. In such a case, shaft 56 can connect to a coupling that pushes or pulls individual drive shafts connected to each of the two pistons and their respective bellows.

The motor of the pipette is operated by switches 44 in a conventional fashion, using a circuit board (not shown) that makes connections within body 42.

Figure 3:
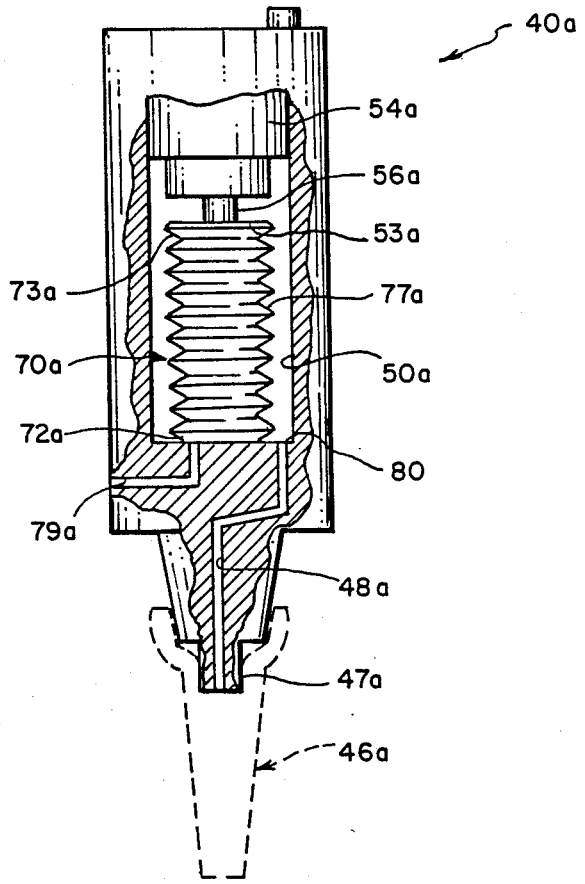
FIG. 3 is a fragmentary elevational view, partly in section, similar to FIG. 2 but illustrating an alternate embodiment of the invention.

The exact location of the base of the bellows vis-a-vis the motor is not a critical aspect of the invention, as shown in FIG. 3. Parts similar to those shown in the previous embodiment bear the same reference numeral, to which the distinguishing suffix "a" has been appended.

Thus, as in the embodiment of FIG. 2, pipette **40*a* comprises a motor 54*a* driving shaft 56*a* to which is attached piston 53*a* that moves in piston chamber 50*a*. Fluid passageway 48*a* connects end 51*a* of chamber 50*a* to end 46*a* where tip locating surfaces 47*a*** are provided.

Bellows 70*a* is attached to piston 53*a* at top portion 73*a* as before. Also, it is the outside surface 77*a* of wall 74*a* that defines, together with chamber 50*a*, the activating air volume for pressurizing and evacuating passageway 48*a*. However, in this case, base 72*a* of bellows 70*a* is secured at end 51*a* of chamber 50*a*, rather than at a location spaced therefrom. Furthermore, passageway 48*a* connects to end 51*a* at an off-center location 80 so as to provide access to the air outside of bellows 70*a*, rather than inside 70*a*. Passage 79*a* vents to the atmosphere. (In this embodiment, tip ejection is preferably achieved by an external ejection system, not shown).

Alternatively, if infinite lifetime is not a major concern, the bellows can be replaced (not shown) by an elastomeric membrane that has been preformed with a cylindrical shape that is similar to the bellows. This preformed shape avoids the cracking that occurs when using a flat, stretchable membrane that has to be deformed each time it is used.

The invention has been described in detail with particular reference to preferred embodiments thereof, but it will be understood that variations and modifications can be effected within the spirit and scope of the invention.

What is claimed is:

1. In a pipette comprising first means for aspirating liquid into the pipette including a fluid passageway through said means, and second means for creating an operative vacuum or a pressure in a said passageway different from atmospheric pressure, said second means including a piston chamber having an end fluidly connected to said fluid passageway, a piston and a bellows mounted for movement within said chamber, said bellows having a preformed sidewall with an inside, generally concave surface and an outside, generally convex surface, and actuating means for advancing or retracting said piston;

the improvement wherein said bellows is mounted in said chamber and on said piston so that said outside convex surface and said piston chamber define the air volume operative on said fluid passageway, whereby said bellows is readily assembled within said chamber and said actuating means requires minimal force to fully extend the piston to said chamber end.

2. In a pipette comprising first means for aspirating liquid into the pipette including a fluid passageway through said means, and second means for creating an operative vacuum or a pressure in said passageway different from atmospheric pressure, said second means including a piston chamber having an end fluidly connected to said fluid passageway, a piston and a bellows mounted for movement within said chamber, and actuating means for advancing or retracting the piston;

the improvement wherein said bellows comprises a base portion sealed to said chamber, a top portion generally opposite to said base portion and secured to said piston, and a generally preformed cylindrical sidewall extending between said base portion and said top portion, said bellows sidewall having an inside, generally concave surface and an outside, generally convex surface, said base portion and said top portion being secured to said chamber and said piston, respectively, so that said sidewall outside surface and said piston chamber define the air volume operative on said fluid passageway;

whereby said bellows is readily assembled in said chamber and said actuating means requires minimal force to fully extend said piston to said chamber end.

3. A pipette as defined in claim 1 or 2, wherein said bellows is sealed to said chamber at an end opposite to said end fluidly connected to said fluid passageway.

4. A pipette as defined in claim 1, wherein said first means comprise a tip-holding surface and further including means for ejecting a disposable tip off said tip-holding surface, said ejecting means including a rod one end of which is mounted in sliding relationship at said end of said chamber fluidly connected to said fluid passageway, and in position to be engaged by said piston when said piston is extended completely to said chamber end.

* * * * *